US005234133A

United States Patent [19]

Kensey

[11] Patent Number: 5,234,133

[45] Date of Patent: Aug. 10, 1993

[54] CONTAINER POURING ATTACHMENT WITH REPLACEABLE POURING STRUCTURES

[76] Inventor: Lenard M. Kensey, R.R. #2, Box 547, Clymer, Pa. 15728

[21] Appl. No.: 42,758

[22] Filed: Apr. 6, 1993

Related U.S. Application Data

[63] Continuation of Ser. No. 786,151, Oct. 31, 1991, abandoned.

[51] Int. Cl.[5] ..... B67D 5/58

[52] U.S. Cl. ..... 222/189; 222/570; 220/700; 220/731

[58] Field of Search ..... 222/189, 567, 570; 220/700, 701, 731, 733

[56] References Cited

U.S. PATENT DOCUMENTS

| | | | |
|---|---|---|---|
| 2,564,979 | 8/1951 | Jorgensen | 220/90 |
| 3,031,112 | 4/1962 | Smith | 222/570 |
| 3,309,000 | 3/1967 | Haverstick | 222/569 |
| 3,356,266 | 12/1967 | Pinter, Jr. | 222/192 |
| 3,853,249 | 12/1974 | Weik, Jr. et al. | 222/570 |
| 3,899,107 | 8/1975 | Gaal | 222/570 |
| 3,987,943 | 10/1976 | Richmond, Jr. | 222/570 |
| 3,994,424 | 11/1976 | Koeller | 222/570 |
| 4,240,568 | 12/1980 | Pool | 222/570 X |
| 4,369,890 | 1/1983 | Bennett | 220/85 R |
| 4,736,874 | 4/1988 | Durant | 222/570 |
| 5,120,454 | 6/1992 | Wieties | 222/189 X |

*Primary Examiner*—Gregory L. Huson

*Attorney, Agent, or Firm*—Michael R. S. Swartz; John R. Flanagan

[57] ABSTRACT

A pouring attachment for use on a container having an annular rim defining an open top of the container includes a resilient, semi-rigid semi-flexible, annular split retainer for mounting about the interior of the container rim and at least one, and preferably, a plurality of different pouring structures, such as of spout, funnel and filter configurations, removably mountable at separate times to the annular split retainer. The different pouring structures are interchangeable with one another for adapting the pouring attachment to accommodate different types of pouring requirements. Each pouring structure is mountable at a prefolded lower edge portion thereof to the annular split retainer so as to surround and completely cover surface portions of the retainer at the pouring side thereof which surface portions would otherwise be contacted by a fluid as it is poured from the container over the pouring attachment. The retainer has a pair of spaced apart adjacent end portions defining the split or gap which is located substantially opposite the pouring structure. The split or gap allows flexing at the opposite side portions of the retainer between contracted and expanded configurations which, in turn, causes the end portions of the retainer to move toward and away from one another and permit installation and removal of the retainer to and from the container rim. Arcuate-shaped upturned finger holds are defined at the end portions of the retainer for facilitating gripping and flexing of the annular retainer.

15 Claims, 5 Drawing Sheets

FIG. 1
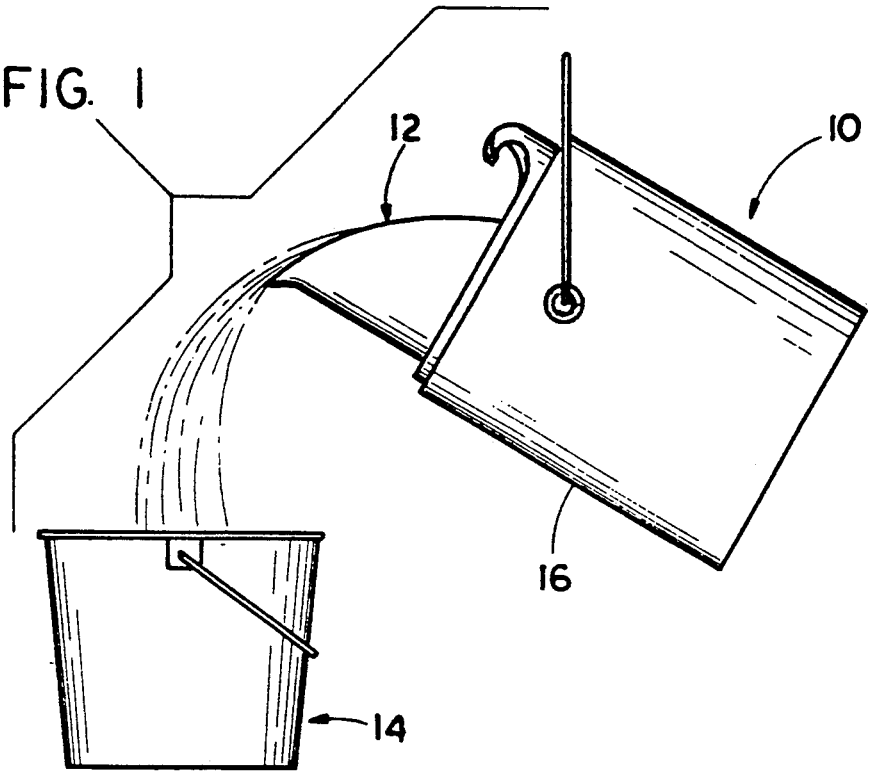
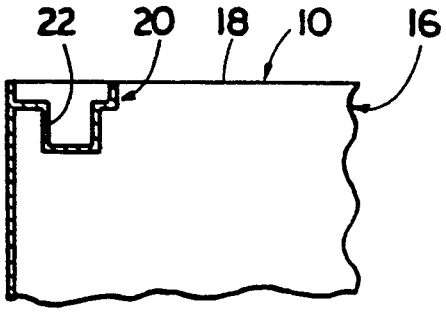
FIG. 2

CONTAINER POURING ATTACHMENT WITH REPLACEABLE POURING STRUCTURES

This is a continuation of co-pending application Ser. No. 07/786,151, filed on Oct. 31, 1991, abandoned.

BACKGROUND OF THE INVENTION

1. Field of the Invention

The present invention generally relates to pouring attachments for containers and, more particularly, is concerned with a pouring attachment for a container having different interchangeable and replaceable pouring structures.

2. Description of the Prior Art

A conventional container for storing paint and other fluids has a cylindrical body with an open top defined by an annular rim having an annular channel which opens upwardly. A pry-off type cover for the container has a downwardly projecting apron which inserts into the annular channel on the container rim to provide a frictional fit with the container rim. It is a common practice to pour paint from the container into another receptacle for mixing the paint, or to pour a desired quantity of paint into a receptacle more convenient for reception of a brush, or a roller, or to fill a sprayer.

In the process of pouring paint from the container, the flow of paint crosses the open channel on the rim, leaving a deposit of paint in the channel. If the paint in the channel is not first removed, the cover apron will force the paint out of the channel, outwardly over the edge of the rim, and down the exterior of the container body, upon resealing the container by replacement of the container cover. The paint deposited in the open channel of the container rim presents an unattractive cleanup task which is both time-consuming and messy.

Pouring attachments have been proposed in the prior patent art for alleviating the aforementioned problem resulting from pouring paint over the open channel of the container rim. Representative of the prior art attachments are the ones disclosed in U.S. Pat. Nos. to Jorgensen (2,564,979), Smith (3,031,112), Haverstick (3,309,000), Pinter, Jr. (3,356,266), Weir, Jr. et al (3,853,249), Gaal (3,899,107), Koeller (3,994,424) and Bennett (4,369,890). These prior art pouring attachments, especially the one disclosed in the Weir, Jr. et al patent, probably overcome the aforementioned problem reasonably well. However, most of these pouring attachments appear to substitute other problems in its place. Now, instead of having to clean the container rim channel, the pouring attachment must be removed and cleaned. Also, the prior art pouring attachments are limited to a single spout-type pouring configuration. If other pouring configurations, such as funnel and filter types, would be useful and desired, then an entire new pouring attachment would have to be manufactured with the different pouring configuration.

Consequently, a need still exists for another approach to pouring attachments for paint-type containers.

SUMMARY OF THE INVENTION

The present invention provides a pouring attachment designed to satisfy the aforementioned needs. In accordance with the present invention, the pouring attachment includes a resilient, semi-rigid, semi-flexible, annular split retainer removably mountable about the interior of the container rim and at least one pouring structure removably mountable to the annular split retainer.

Preferably, a plurality of different pouring structures are provided, each being removably mountable at separate times to the annular split retainer.

The different pouring structures are interchangeable with one another for adapting the pouring attachment to accommodate different types of pouring requirements. By way of example, three different type of pouring configurations are disclosed—spout, funnel, and filter configurations.

Each pouring structure is disposable and replaceable after each use, if desired, so as to eliminate the necessity for clean-up. Each pouring structure has a lower edge portion which is prefolded to define an upwardly-opened annular pocket adapted to receive and wrap partially about the annular split retainer so as to surround and completely cover surface portions of the retainer which otherwise would be contacted by a fluid, such as paint, as it is poured from the container over the pouring attachment. Specifically, the surface portions of the annular split retainer which are encompassed by the pouring structure are the inner and outer circumferential surfaces and a lower surface located at a pouring side of the retainer. Thus, the provision of the pouring structure eliminates the necessity to clean the annular split retainer.

The outer circumferential surface of the annular split retainer has a cross-sectional profile configured to mate with the inner circumferential surface of the container rim. The retainer has a pair of spaced apart adjacent end portions defining the split or gap in the retainer which is located substantially opposite the pouring structure. The presence of the split or gap allows flexing at the opposite side portions of the annular split retainer between contracted and expanded configurations which, in turn, causes the end portions of the retainer to move toward and away from one another and permit installation and removal of the retainer to and from the container rim. Arcuate-shaped upturned finger holds are defined at the end portions of the annular split retainer for facilitating gripping and flexing of the retainer.

Also, in accordance with the present invention, the pouring attachment includes a ramp extension mountable to an interior side of the pouring structure adjacent the annular rim of the container. The ramp extension extends from the pouring structure into contact with a body of the container at a location spaced below its rim to define a path for flow of a final portion of the fluid from the container body to the pouring structure. The ramp extension is an elongated strip having an upper end attachable to the interior side of the pouring structure and a lower end spaced from the upper end. The lower end has a concave arcuate shape adapted to make contact with the body of the container along a curved line to promote draining of fluid from the ramp extension whenever the container is moved from a tilted pouring position to an upright resting position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 1 is a side elevational view of an open-top storage container in a tilted pouring position with a pouring attachment of the present invention mounted thereto and being used in the pouring of a fluid, such as paint, from the storage container into a bucket.

FIG. 2 is an enlarged fragmentary sectional view of the storage container of FIG. 1 showing a cross-section of an annular rim of the container.

DETAILED DESCRIPTION OF THE INVENTION

Figure 4:
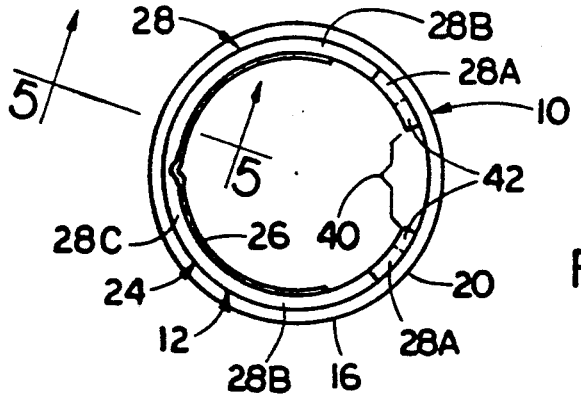
FIG. 4 is a top plan view of the storage container and pouring attachment as seen along line 4—4 of FIG. 3.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIGS. 1-5, there is shown a conventional storage container 10 for paint and other fluids having removably mounted thereto a pouring attachment 12 of the present invention. The storage container 10 is shown in FIG. 1 in a tilted pouring position with the pouring attachment 12 being used to assist in the pouring of a fluid, such as paint, from the container 10 into a bucket 14.

The storage container 10 has a cylindrical body 16 with an open top 18 defined by an annular rim 20 having an annular channel 22 which opens upwardly. A pry-off type cover (not shown) is typically used to close the open top 18 of the container 10. Such cover has a downwardly projecting apron which inserts into the annular channel 22 on the container rim 20 to provide a frictional fit therewith.

Referring to FIGS. 1 and 3-8, the pouring attachment 12 basically includes a resilient, semi-rigid, semi-flexible, annular split retainer 24 removably mountable about the interior of the container rim 20 and a pouring structure 26 removably mountable to the annular split retainer 24. Preferably, the annular split retainer 24 is composed of a suitable plastic material, whereas the pouring structure is composed of a suitable paper material, such as kraft paper.

The annular split retainer 24 has a solid ring-shaped body 28 with upper and lower spaced surfaces 30, 32 and inner and outer spaced apart circumferential surfaces 34, 36 extending between and interconnecting the upper and lower surfaces 30, 32. The upper and lower surfaces 30, 32 lie in generally parallel planes, whereas the inner circumferential surface 34 is of cylindrical shape. The outer circumferential surface 36 of the annular split retainer 24 has a cross-sectional profile configured to mate with the profile of the inner circumferential surface 38 of the container rim 20.

Figure 5:
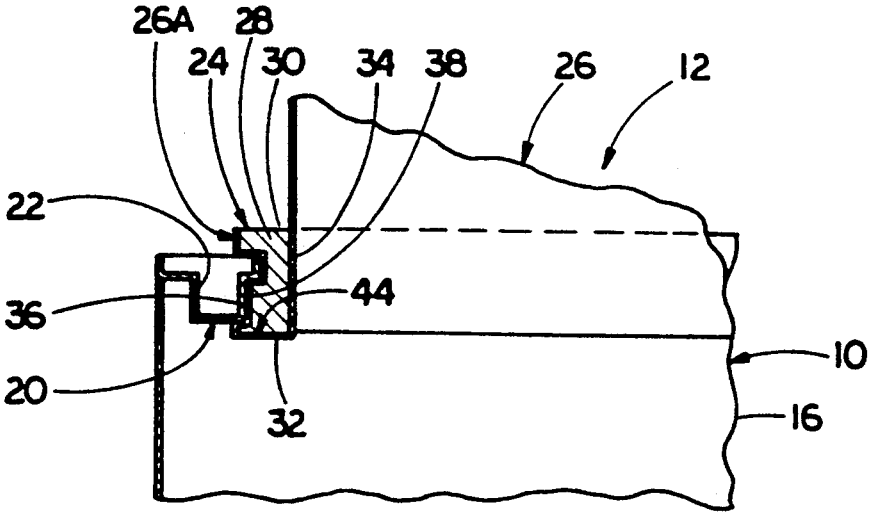
FIG. 5 is an enlarged fragmentary sectional view of the storage container and pouring attachment mounted thereto taken along line 5—5 of FIG. 4.
Figure 6:
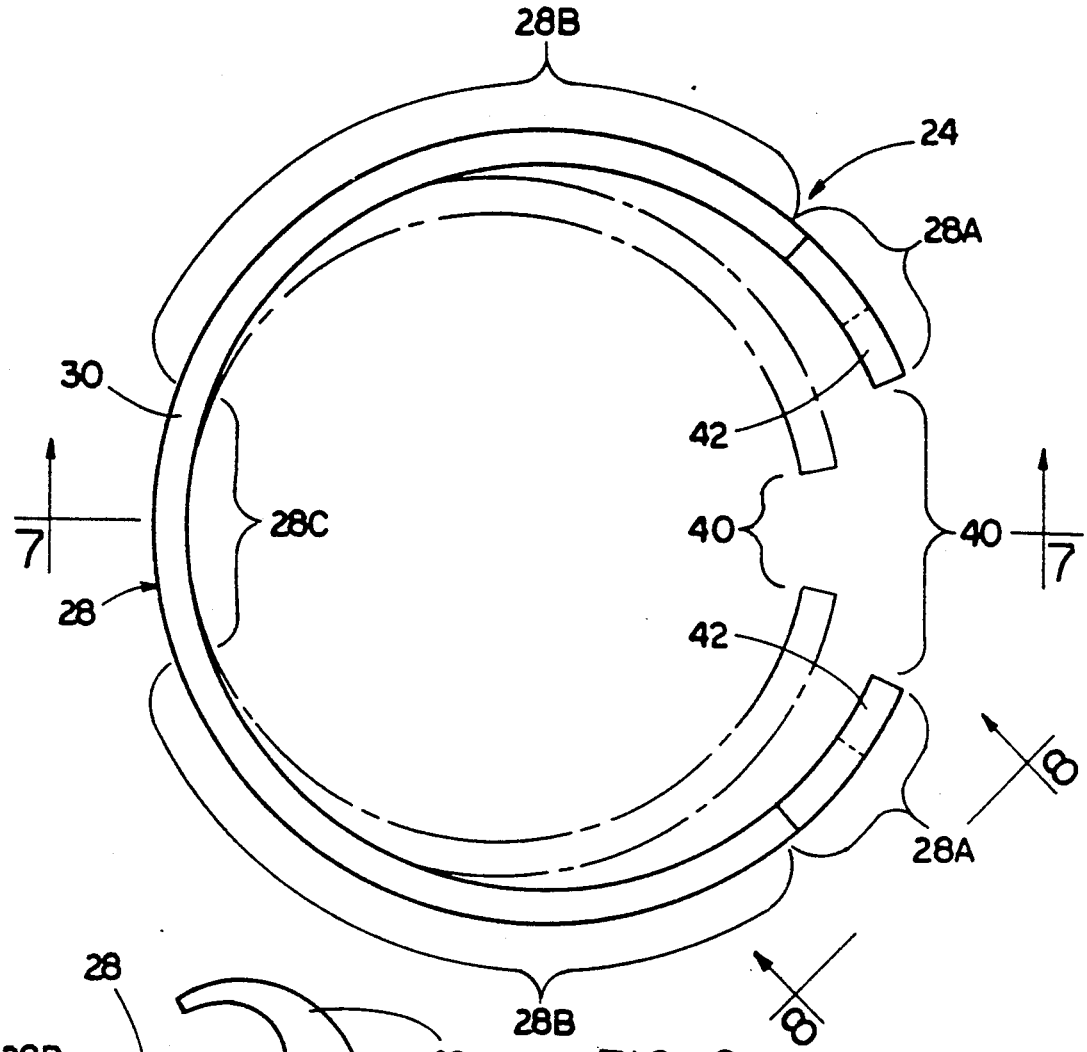
FIG. 6 is a top plan view similar to that of FIG. 4, but showing an annular split retainer of the pouring attachment by itself.
Figure 8:
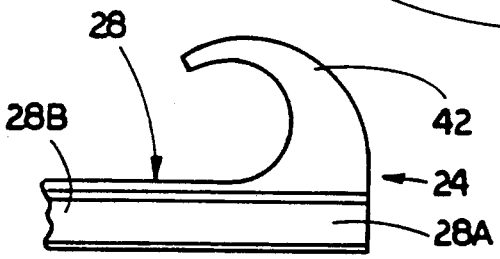
FIG. 8 is an enlarged fragmentary side elevational view of the annular split retainer as seen along line 8—8 of FIG. 6.
Figure 7:
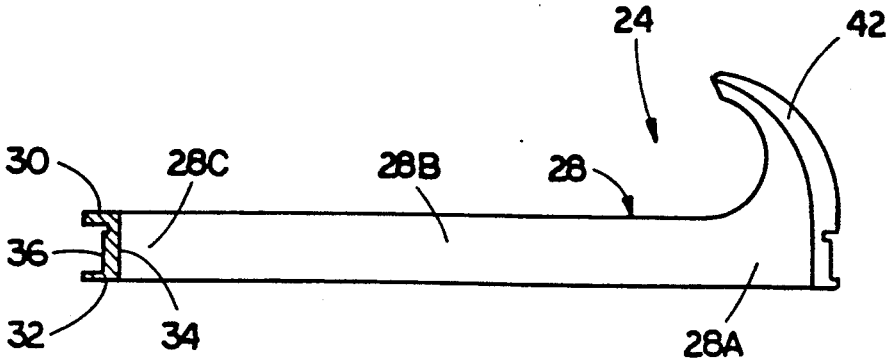
FIG. 7 is a cross-sectional view of the annular split retainer taken along line 7—7 of FIG. 6.

The body 28 of the annular split retainer 24 also has a pair of spaced apart adjacent end portions 28A defining the split or gap 40 in the retainer 24 which is located substantially opposite the pouring structure 26. The presence of the split or gap 40 and the use of a suitable semi-rigid, semi-flexible material composing the retainer body 28 allows flexing of the retainer 24 at the opposite side portions 28B of the body 28 between a contracted configuration, as shown in dashed outline form in FIG. 6, and an expanded configuration, as shown in solid line form in FIG. 6. Such flexing of the retainer body 28 between the contracted and expanded configurations, in turn, causes the end portions 28A of the retainer body 28 to move toward and away from one another and permit installation and removal of the retainer 24 to and from over the inner circumferential surface 38 of the container rim 20, as best seen in FIGS. 4 and 5. Also, means in the form of a pair of arcuate-shaped upturned finger holds or hooks 42 are respectively integrally connected to and project above the end portions 28A of the retainer body 28. The finger holds 42 can be gripped by a user's fingers in order to carry out flexing of the retainer 24 from its normally expanded (or relaxed) configuration to the contracted configuration.

Figure 15:
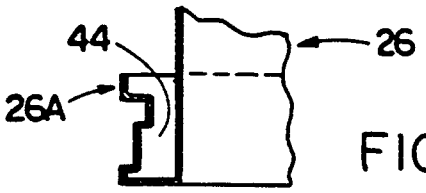
FIG. 15 is a view similar to that of FIG. 5 but showing a foldable edge portion on the pouring structure of any one of the three different configurations shown in FIGS. 9-10, 11-12 and 13-14.

Referring now to FIGS. 4, 5 and 15, the pouring structure 26 has a non-continuous arcuate shape extending than 360° and is removably mountable to the body 28 of the annular split retainer 24 so as to extend substantially perpendicular to a plane defined by the annular split retainer and encompass only the pouring side thereof, such being along a front portion 28C and the opposite side portions 28B thereof. The pouring structure 26 has a lower edge portion 26A which is prefolded to define an upwardly-opened annular pocket 44 adapted to receive and wrap partially about the body 28 of the annular split retainer 24 so as to surround and completely cover the portions of the lower, inner and outer surfaces 32, 34, 36 of the retainer body 28 which otherwise would be contacted by a fluid, such as paint, as it is poured from the container 10 over the installed pouring attachment 12. Specifically, as seen in FIGS. 5 and 15, the lower end portion 16A of the pouring structure has a cross-sectional profile configurated to mate with that of the inner circumferential surface 38 of the ring and the outer circumferential surface 36 of the retainer body 28. By covering the portions of the inner and outer circumferential surfaces 34, 36 and of the lower surface 32 of the retainer 24 located at the pouring half or side thereof, the pouring structure 26 thereby eliminates the necessity to clean the annular split retainer after use.

Figure 3:
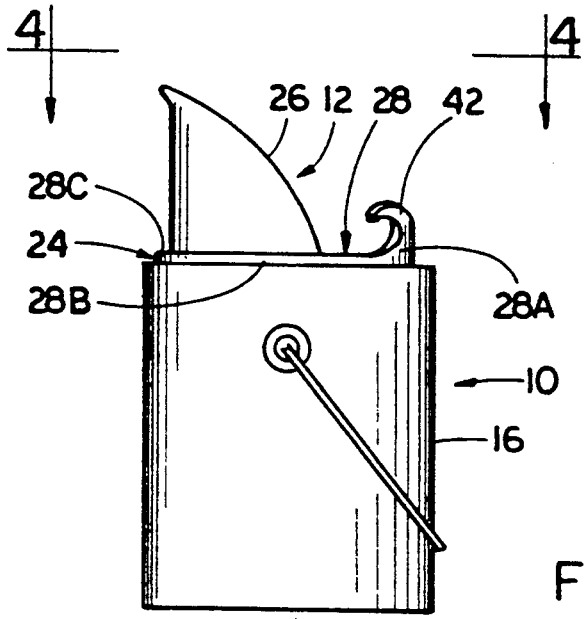
FIG. 3 is a side elevational view of the storage container in an upright non-pouring position with the pouring attachment of FIG. 1 mounted thereto.
Figure 9:
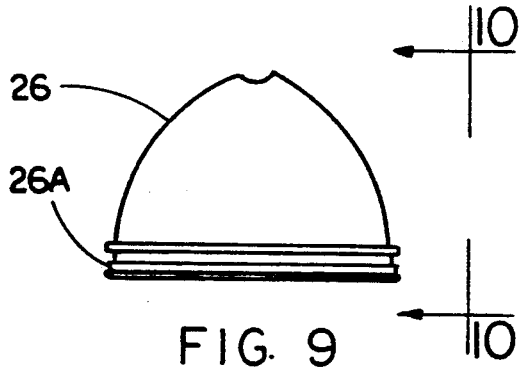
FIG. 9 is a front elevational view of the pouring structure of the pouring attachment having a spout configuration.
Figure 10:
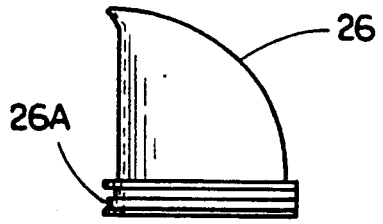
FIG. 10 is a side elevational view of the pouring structure as seen along line 10—10 of FIG. 9.
Figure 11:
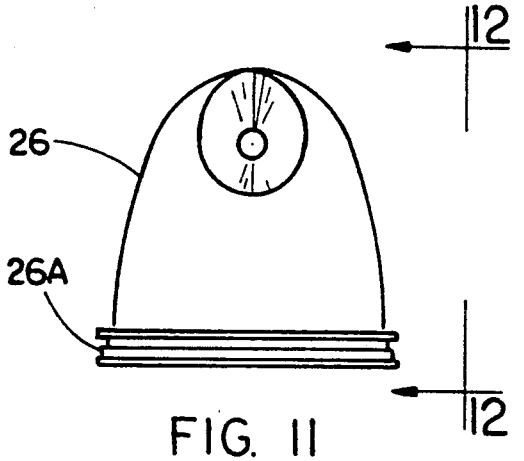
FIG. 11 is a front elevational view of the pouring structure of the pouring attachment having a funnel configuration.
Figure 12:
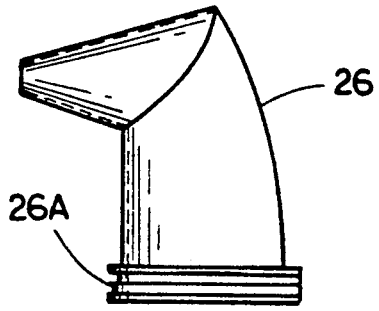
FIG. 12 is a side elevational view of the pouring structure as seen along line 12—12 of FIG. 11.
Figure 13:
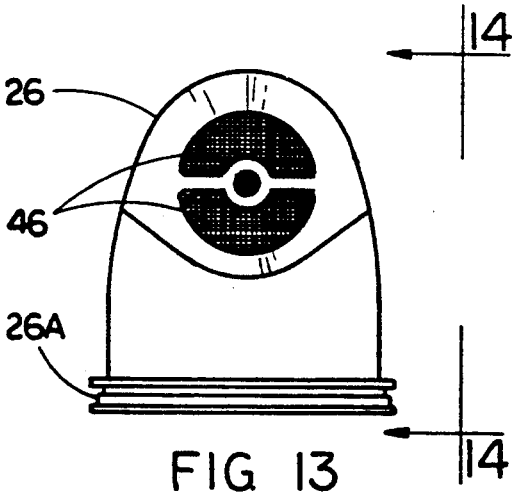
FIG. 13 is a front elevational view of the pouring structure of the pouring attachment having a filter configuration.
Figure 14:
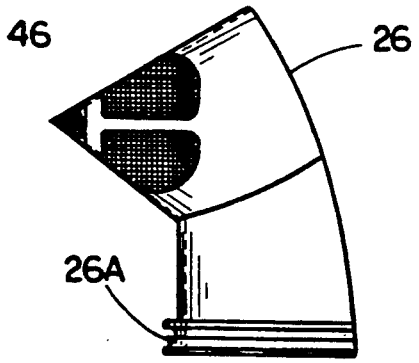
FIG. 14 is a side elevational view of the pouring structure as seen along line 14—14 of FIG. 13.

Referring to FIGS. 9–14, preferably, a plurality of different pouring structures 26 are provided. By way of example, three different designs of pouring configurations are disclosed. FIGS. 9 and 10, as well as FIGS. 1 and 3, illustrate a pouring structure 26 having a spout configuration. FIGS. 11 and 12 depict a pouring structure 26 having a funnel configuration. FIGS. 13 and 14 show a pouring structure 26 having a filter configuration. The filter pouring structure 26 includes a mesh material 46 for straining the fluid flowing from the container 10 through it. Each pouring structure 26 is removably mountable at separate instances to the annular split retainer 24. Also the pouring structures 26 of the different configurations are interchangeable with one another for adapting the pouring attachment 14 to accommodate each of the different ways of pouring the fluid from the container 10. By fabricating each pouring structure 26 from low cost kraft paper, the pouring structure 26 is thereby designed for disposable and replaceable after each use, if desired. In such manner, the necessity for clean-up is eliminated.

Figure 16:
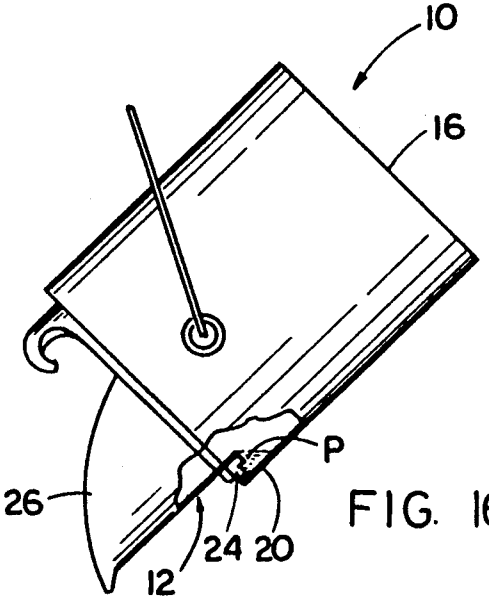
FIG. 16 is a side elevational view of an open-top storage container with the pouring attachment of the present invention mounted thereto, but showing a final portion of a fluid, such as paint, trapped behind a lower portion of the annular rim of the container such that it will not flow from the container over the pouring attachment.
Figure 17:
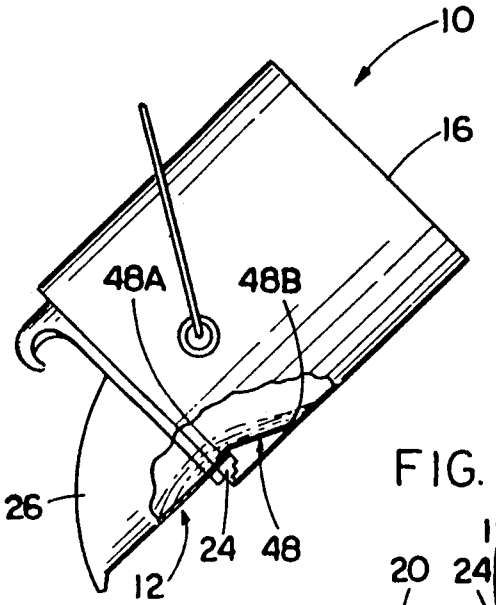
FIG. 17 is another side elevational view similar to that of FIG. 16 but with the pouring attachment of the present invention including a ramp extension to provide a path from flow of the final portion of fluid from the container to the pouring structure of the attachment.

As described heretofore, the pouring attachment 12 of the present invention assists in the pouring of a fluid, such as paint, from the container 10. However, as represented in FIG. 16, a final portion P of the fluid remains in the container 10, trapped behind a lower portion of the annular rim 20 of the container 10 where it is unable to flow from the container 10 over the pouring attachment 12. Referring to FIG. 17, there is illustrated a ramp extension 48 also provided by the present invention which is incorporated by the pouring attachment 12 to provide a path for flow of the final portion P of fluid from the container 10 to and over the pouring structure 26 of the pouring attachment 12.

Figure 19:
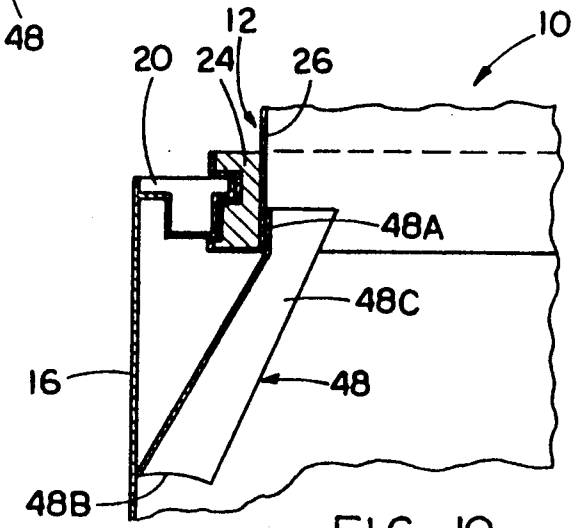
FIG. 19 is a view similar to that of FIG. 5 also showing the ramp extension installed on the pouring structure of the pouring attachment.
Figure 18:
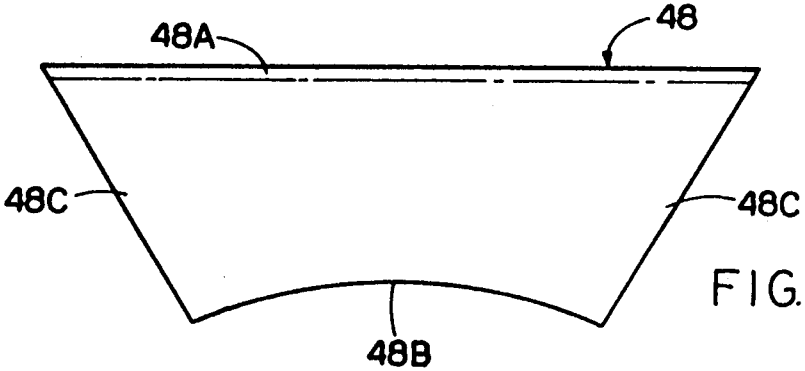
FIG. 18 is a plan layout view of the ramp extension employed by the pouring attachment.

Referring to FIGS. 17–19, the ramp extension 48 of the pouring attachment 12 is mountable, such as by use of a suitable adhesive, to an interior side of the lower edge portion 26A of the pouring structure 26 adjacent the annular rim 20 of the container 10. The ramp extension 48 extends from the pouring structure 26 into contact with the container body 16 at a location spaced below the rim 20. The ramp extension 48 blocks the final portion P of the fluid from running behind the rims 20 and instead defines a path for the flow of the final fluid portion P from the container 10 to the pouring structure 26.

More particularly, the ramp extension 48 is in the form of an elongated strip having an upper end 48A with an adhesive thereon adapting it for attachment to the interior side of the lower edge portion 26A of the pouring structure 26. Also, the ramp extension strip 48 has a lower end 48B spaced from the upper end 48A. The upper end 48A has a generally linear or straight shape, while the lower end 48B has a concave arcuate shape adapting it to make contact with the container body 16 along a curved line which promotes draining of fluid from the ramp extension 48 whenever the container 10 is moved from a tilted pouring position to an upright resting position before the final portion P is to be poured from the container 10 to empty the container. The ramp extension strip 48 further has a pair of opposite sides 48C which converge toward one another from the upper end 48A to the lower end 48B. The length of the ramp extension strip 48 between its opposite sides 48C and along the rim 2 is less than that of the pouring structure 26. Preferably, the ramp extension 48 is fabricated from the same material as the pouring structure 26.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A pouring attachment for use on a container having an annular rim defining an open top of the container, said attachment comprising:

(a) a resiliently semi-rigid, semi-flexible, annular split retainer removably mountable about an interior of the annular rim of the container, said annular split retainer having a pouring side and an opposite non-pouring side; and (b) a pouring structure having a non-continuous arcuate shape extending less than 360° an being removably mountable to said annular split retainer so as to extend substantially perpendicular to a plane defined by said annular split retainer and encompass only said pouring side of said annular split retainer, said non-pouring side of said annular split retainer having a pair of spaced apart adjacent end portions defining a gap therebetween which is located substantially opposite said pouring structure, said annular split retainer being capable of flexing circumferentially between contracted and expanded configurations which, in turn, cause said end portions thereof to move toward and away from one another and permit installation and removal of said retainer to and from the container rim;

(c) said pouring structure having a lower edge portion being prefolded to define an upwardly-opened annular pocket adapted to receive and wrap partially about said annular split retainer so as to surround and completely cover surface portions of said retainer which otherwise would be contacted by a fluid as it is poured from the container over said pouring attachment;

(d) said preformed lower edge portion of said pouring structure and said outer circumferential surface of said annular split retainer having respective cross-sectional profiles substantially identically configured to conform in shape and mate with one another and with an inner circumferential surface on the interior of the container rim.

2. The attachment as recited in claim 1, wherein:

said annular split retainer is composed of a plastic material; and said pouring structures are composed of a paper material.

3. The attachment as recited in claim 1, further said surface portions of said annular split retainer are inner and outer circumferential surfaces and a lower surface.

4. The attachment as recited in claim 1, wherein said end portions of said annular split retainer have respective upturned finger holds for facilitating gripping and flexing of said retainer.

5. The attachment as recited in claim 1, wherein said pouring structure has a spout configuration.

6. The attachment as recited in claim 1, wherein said pouring structure has a funnel configuration.

7. The attachment as recited in claim 1, wherein said pouring structure has a filter configuration.

8. A pouring attachment for use on a container having a continuous sidewall and an annular rim thereon defining an open top of the container, said attachment comprising:

(a) a resiliently semi-rigid, semi-flexible, annular split retainer removably mountable about an interior of the annular rim of the container;

(b) a pouring structure removably mountable to said annular split retainer; and (c) a ramp extension mountable to an interior side of said pouring structure adjacent the annular rim of the container and extending therefrom into contact with the sidewall of the container at a location spaced below the rim to define a path for flow of a final portion of the fluid from the container body to said pouring structure.

9. The attachment as recited in claim 8, wherein said ramp extension is an elongated strip having an upper end mountable to said interior side of said pouring structure and a lower end spaced from said upper end and having a concave arcuate shape adapted to make contact with the container body along a curved line to promote draining of fluid from said ramp extension when the container is moved from a tilted pouring position to an upright resting position.

10. A pouring attachment for use on a container having an annular rim defining an open top of the container, said attachment comprising:

(a) a resiliently semi-rigid, semi-flexible, annular split retainer removably mountable about an interior of the annular rim of the container, said annular split retainer having a pouring side and an opposite non-pouring side; and (b) a plurality of different pouring structures, each having a non-continuous arcuate shape extending less than 360° and being removably mountable at separate times to said annular split retainer so as to extend substantially perpendicular to a plane defined by said annular split retainer and encompass only said pouring side thereof, said non-pouring side of said annular split retainer having a pair of spaced apart adjacent end portions defining a gap therebetween which is located substantially opposite said pouring structure, said annular split retainer being capable of flexing circumferentially between contracted and expanded configurations which, in turn, cause said end portions thereof to move toward and away from one another and permit installation and removal of said retainer to and from the container rim;

(c) each of said pouring structures having a lower edge portion being prefolded to define an upwardly-opened annular pocket adapted to receive and wrap partially about said annular split retainer so as to surround and completely cover surface portions of said retainer which otherwise would be contacted by a fluid as it is poured from the container over said pouring attachment;

(d) said preformed lower edge portion of each pouring structure and said outer circumferential surface of said annular split retainer having respective cross-sectional profiles substantially identical configured to conform in shape and mate with one another and with an inner circumferential surface on the interior of the container rim.

11. The attachment as recited in claim 10 wherein:

said annular split retainer is composed of a plastic material; and said pouring structures are composed of a paper material.

12. The attachment as recited in claim 10, wherein said different pouring structures are interchangeable with one another for adapting said attachment to accommodate different types of pouring.

13. The attachment as recited in claim 10, wherein one of said pouring structures has a spout configuration.

14. The attachment as recited in claim 10, further comprising:

a ramp extension mountable to an interior side of said pouring structure adjacent the annular rim of the container and extending therefrom into contact with a body of the container at a location spaced below the rim to define a path for flow of a final portion of the fluid from the container body to said pouring structure.

15. The attachment as recited in claim 14, wherein said ramp extension is an elongated strip having an upper end mountable to said interior side of said pouring structure and a lower end spaced from said upper end and having a concave arcuate shape adapted to make contact with the container body along a curved line to promote draining of fluid from said ramp extension when the container is moved from a tilted pouring position to an upright resting position.

* * * * *